United States Patent [19]

Alexander et al.

[11] 4,155,539

[45] * May 22, 1979

[54] HAULAGE WINCHES

[75] Inventors: William Alexander, Potters Bar; John T. H. Webb, Sunningdale, both of England

[73] Assignee: Wharton Engineers (Elstree) Limited, Hertfordshire, England

[ * ] Notice: The portion of the term of this patent subsequent to Mar. 8, 1994, has been disclaimed.

[21] Appl. No.: 803,293

[22] Filed: Jun. 3, 1977

Related U.S. Application Data

[63] Continuation-in-part of Ser. No. 758,410, Jan. 11, 1977, Pat. No. 4,111,398, which is a continuation of Ser. No. 569,394, Apr. 18, 1975, abandoned, which is a continuation-in-part of Ser. No. 458,410, Apr. 5, 1974, abandoned.

[51] Int. Cl.[2] ..... B66D 1/76

[52] U.S. Cl. ..... 254/175.7; 254/183

[58] Field of Search ..... 254/175.5, 175.7, 175.3, 254/138, 150 R, 183, 184; 114/253, 154; 242/54 R, 155 B; 226/108; 74/230.9, 230.17 A

[56] References Cited

U.S. PATENT DOCUMENTS

| | | | |
|---|---|---|---|
| 488,001 | 12/1892 | French | 254/183 |
| 3,300,187 | 1/1967 | Saxe et al. | 254/175.7 |
| 3,730,483 | 5/1973 | Newell | 254/175.5 |
| 3,776,519 | 12/1973 | Hamilton | 254/175.7 |
| 3,917,229 | 11/1975 | Ayme | 254/175.5 |

FOREIGN PATENT DOCUMENTS

| | | | |
|---|---|---|---|
| 1224647 | 3/1971 | United Kingdom | 254/183 |

*Primary Examiner*—Trygve M. Blix
*Assistant Examiner*—Kenneth W. Noland
*Attorney, Agent, or Firm*—Arnold, White & Durkee

[57] ABSTRACT

A multi-capstan winch has a pair of haulage capstans and at least one delivery capstan associated therewith. In delivering cable to the haulage capstans, the delivery capstan considerably reduces the loading on the cable, thereby allowing haulage capstans of a reduced diameter and weight. The delivery capstan is preferably coaxial with one of the haulage capstans, is a single groove capstan, has a relatively larger diameter than that of the haulage capstans, and has a cable wrap of greater than 180 degrees, but less than 306 degrees, preferably on the order of 220 degrees. Advantageously, the winch is driven by a chain of gears having the majority of the gears being mounted on shafts which lie substantially in a horizontal plane passing through the axes of the capstans.

19 Claims, 4 Drawing Figures

FIG. 3
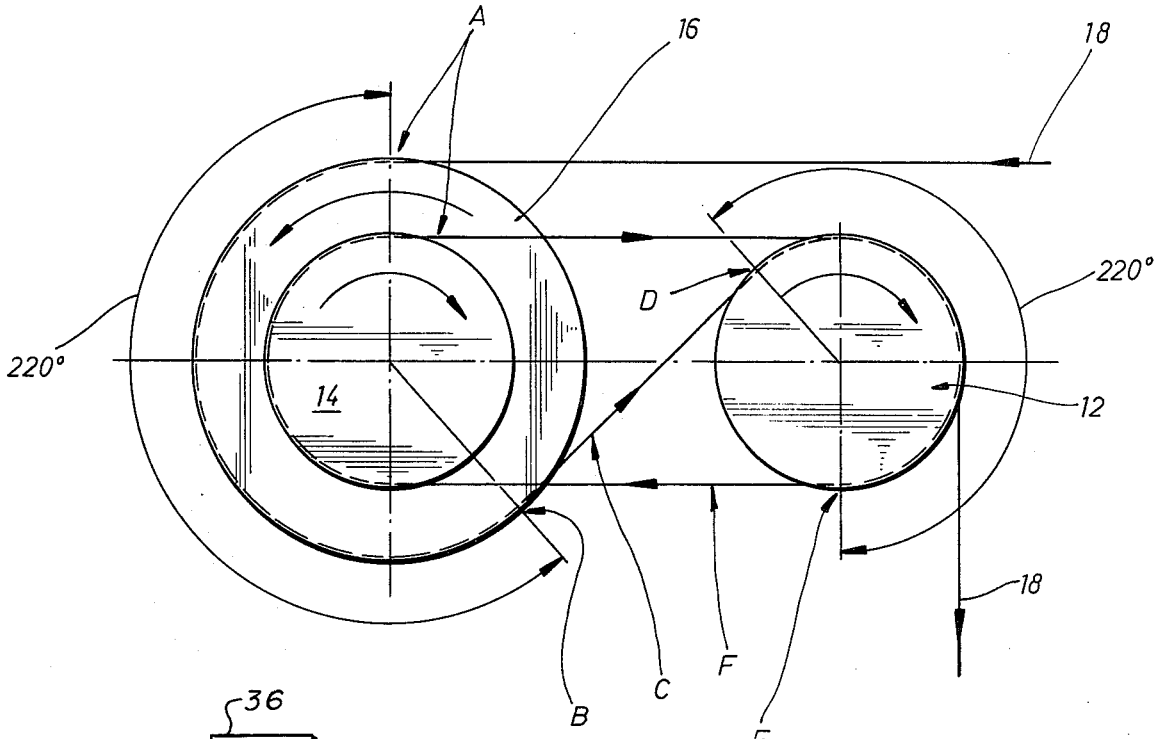
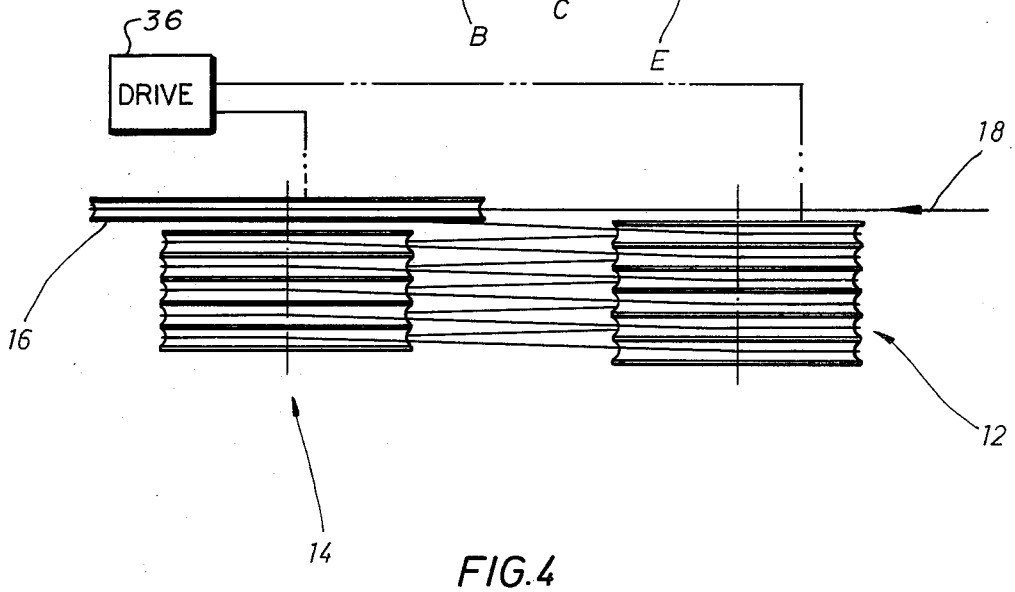
FIG. 4

HAULAGE WINCHES

RELATED APPLICATION

This application is a continuation-in-part of application IMPROVEMENT RELATING TO HAULAGE WINCHES, Ser. No. 758,410, filed Jan. 11. 1977 now Pat. No. 4,111,393, which is a continuation of Ser. No. 569,394, filed Apr. 18, 1975 now abandoned; which is a CIP of 458,410 filed 4/5/74 now abandoned. The application serial number 569,394 is expressly incorporated herein by reference in its entirety.

BACKGROUND OF THE INVENTION

This invention relates to a multi-capstan haulage winches in general, and more specifically to twin-capstan arrangements having a third capstan associated therewith for delivering line to the twin capstans.

U.S. Pat. No. 3,834,673, entitled Twin Capstan Winches, to Alexander describes a haulage winch comprising twin haulage drum, i.e. twin, multi-groove capstans, and a chain of gears for driving the haulage capstans. The majority of the gears are mounted on shafts which lie in or are adjacent to a substantially horizontal plane in which the axes of the haulage capstans lie.

Although the described winch is an advance over previous winch designs, high bending and compression stresses can occur in the bearings and mounting of the haulage capstans. As the diameter of the capstan increases for accommodating various cable or line diameters and loading requirements, such stresses increase, along with the power supply requirements for driving the twin capstans. This not only necessitates a more expensive system, but also a more massive system of increased dimensions which could pose problems for many applications.

Because of known advantages over conventional reel-type drum winches, the twin capstan winches, such as above referenced, have achieved widespread usage. For example, in capstan winches, the line progresses smoothly over the capstans at a speed determined by the driving motor, as only a single layer of line builds on the capstans. The spooling of the line for storage is at relatively low tensions, preventing damage to the line even if the load varies. Still further, the reeling or storage drum can be constructed (or changed) according to the length of the line to be hauled in and may also be situated in a convenient place distant from the capstan unit.

On the other hand, even though a reel-type drum winch may have a tendency to crush the line and must be geared to accommodate the maximum torque on the outer wrap of the line around its drum, a reel-type winch does not require the added expense of a plurality of drum units for implementing an effective system. This is a feature which, absent other considerations, is believed to heretofore have eliminated any advantages obtained by associating a capstan unit with a reel-type drum winch.

Of course, for certain applications wherein circumstances call for independent operation of two separate winding units, a capstan unit may be used in association with a reel-type drum winch for achieving the overall objective. Such a case is an integrated chain-wire rope mooring system wherein a reel-type winch is provided for hauling in and storing the line, and a windlass wildcat is provided for hauling in the chain. By operating the wildcat when the winch is not hauling in, the chain may be deposited in a storage compartment. In such an application, there may be a brief period when both the windlass and the winch are hauling in under power; since both winch and windlass are already available, the operation of the windlass to assist the winch is at no extra system cost. However, it is not believed that capstan units have been associated with reel-type drum winches primarily for reducing the loading on the reel-type drum winch during haul in. The slippage inherent on a capstan type unit, especially on a less than full wrap capstan unit, is believed not to have justified its use for reducing the loading on a reel-type winch.

SUMMARY OF THE INVENTION

An improved winch is provided which utilizes a third or delivery capstan to deliver line to a multi-capstan arrangement for reducing the load provided to the multi-capstan arrangement, thereby allowing less massive and reduced-in-size capstans to be utilized in the multi-capstan arrangement. By providing a wrap of the line around the delivery capstan which is greater than 180 degrees and less than a full wrap, traction for the delivery capstan is increased over a similar arrangement having only a 180 degree wrap on the delivery capstan; this further reduces the loading on the multi-capstan arrangement. By choosing a diameter for the delivery capstan of relatively large dimension, a relatively large initial bend radius is provided to the line where the load is the greatest, thereby assuring against over-stressing of the line.

In the preferred embodiment the multi-capstan winch includes at least first, second, and third rotatably driven capstans. The second and third capstans are of a reduced diameter, and the first capstan is of an enlarged diameter. The second and third capstan have a plurality of wraps of the hauling line, and the first capstan has less than a single full wrap but more than an one-half wrap of the hauling line.

According to a feature of the invention, the angle of the wrap around the first capstan is between 190 degrees and 300 degrees, and preferably is approximately 220 degrees.

According to another feature of the invention, the hauling line unimpededly runs directly from the first capstan to the second capstan so that the first capstan provides the greatest assistance in hauling power to the second capstan.

In yet another aspect of the invention, all of the capstans have co-planer axes, and the hauling line initially engages the first capstan on one side of the axial plane. The line then disengages from the first capstan on the other side of the capstan plane, and engages the second capstan on the one side of the plane. Although it is not necessary, preferably the first capstan is coaxial with either the second or third capstan.

According to the method of the invention, line is hauled in using apparatus which includes a double capstan winch. The method comprises the steps of:

(a) Passing the line around a third driven capstan, whereby the angle of wrap around the third capstan is greater than one-half a turn but less than a full turn; and (b) coupling the line from the third capstan to the double capstan winch.

According to the method of the invention, the angle of wrap around a third capstan is within the range of 190 degrees–300 degrees and preferably is substantially 220 degrees. Further, the step of coupling preferably includes the step of unimpededly passing the line directly between the third capstan and the double capstan winch.

It is accordingly a general object of the present invention to provide a new and improved multi-capstan winch which utilizes still another driven capstan for achieving a multi-capstan winch of an overall reduced size and weight.

Other objects and features of the present invention will become apparent upon a reading a detailed description of a preferred embodiment in conjunction with accompanying drawings; wherein:

BRIEF DESCRIPTION OF THE DRAWINGS

FIGS. 3 and 4 show another embodiment of the multi-capstan winch according to the invention wherein the haulage capstan is coaxial with one of the other capstans of the winch.

DETAILED DESCRIPTION OF PREFERRED EMBODIMENTS

Figure 2:
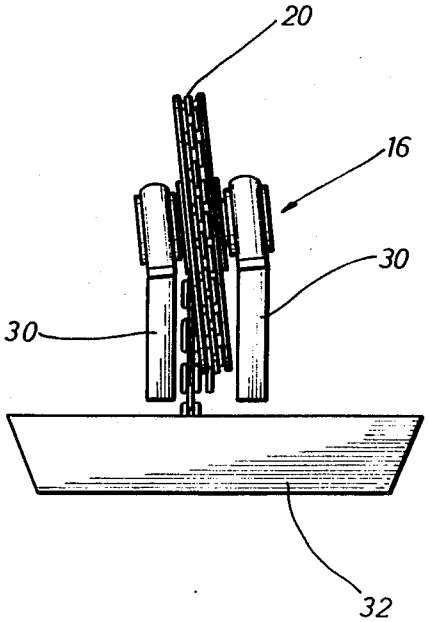
FIG. 2 shows a front view of the haulage capstan of the multi-capstan winch of FIG. 1.
Figure 1:
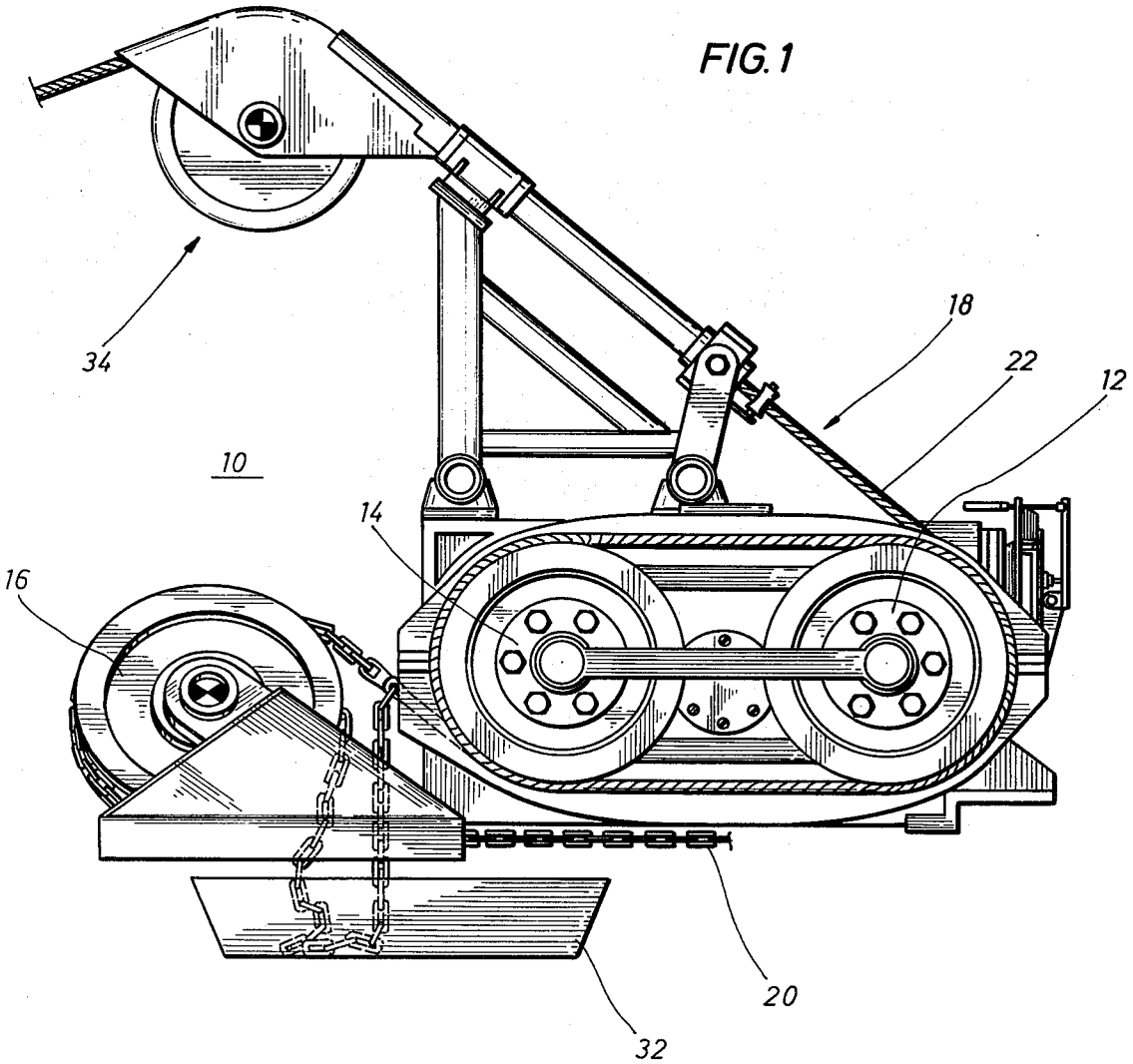
FIG. 1 depicts a side elevation view of a multi-capstan haulage winch, including a haulage capstan, for handling cable and chain in sequence.

Referring now to FIGS. 1 and 2, one embodiment of a multi-capstan winch 10 is shown. The haulage winch 10 includes a plurality of driven capstans 12, 14, 16 which are driven in coordination for accommodating a hauling line 18 consisting of both chain 20 and cable 22. The capstans 12, 14, 16 have substantially parallel, horizontal rotational axes which preferably lie substantially in the same plane.

The capstan 16 is a haulage capstan having a single groove designed to accommodate both the chain 20 and the cable 22. The haulage capstan 16 has a diameter larger than that of the capstans 12, 14, and is constructed and arranged in relation to the capstans, 12, 14 for delivering the line 18 to the capstans 12, 14.

The haulage capstan 16 is disposed substantially at the level of the horizontal plane containing the rotational axes of the capstans 12, 14, and the rotational axes of the haulage capstan 16 is slightly inclined to the horizontal.

A pair of guide plates 30 are connected to axial housings of the haulage capstan 16. The guide plates 30 extend substantially parallel to one another on either side of the capstan 16, to a position below the lowest portion of the capstan 16. The guide plates 30 are intended to guide the chain 20 delivered from the haulage capstan 16 to a chain collecting locker 32 disposed beneath the guide plates 30.

An automatic spooling device 34 for feeding cable from the capstans 12, 14 to a storage drum (not shown) is disposed above the capstan winch. The spooling device 34 and the storage drum are conventional and need not be described. For example, a suitable storage drum and a suitable drive mechanism 36 for the capstans 12, 14 is described in U.S. Pat. No. 3,834,673, issued Sept. 10, 1974 to Alexander and assigned to the assignee of the present invention. As disclosed in the Alexander patent, the capstan winch comprises a chain of reduction gears and at least one bevel gear, whereby the axes of rotation of the twin capstan 12, 14 is at right angles to the axes of rotation of the power input shaft. The gears are housed in a generally L-shaped gearbox having a longer part extending parallel to the power input shaft and a shorter part extending at right angles to the longer part. The power input shaft extends through one wall of a casing of the shorter part of the gearbox. The shorter gearbox part includes a number of spur gears and includes provision for selecting forward drive of the twin haulage capstans.

Each capstan is rotatable on a respective shaft to which a spur gear is attached, and a main drive shaft lies between the shafts of the twin haulage capstans. The main drive shaft carries a spur gear in driving contact with both the spur gears on the shafts of the haulage drums. The main drive shaft also has a crown gear of a bevel gear secured thereto.

The shafts of the twin haulage drums, the main drive shaft, and the crown wheel are all located in the longer gearbox part, and a connecting shaft connects the shorter and longer gearbox parts. One end of the connecting shaft lies within the shorter gearbox part and has a spur gear fixedly mounted thereon, and the other end of the connecting shaft has bevel pinion gear fixedly mounted thereon. The bevel pinion gear meshes with the crown gear.

Further as described in the Alexander patent, the storage drum is driven from the gearbox via a friction coupling. The gearing is such that but for relative movement, i.e. slipping of the parts of the friction coupling, the storage drum would be driven to reel in cables during pulling of a load at a higher speed than the cable is reeled in by rotation of the haulage drums.

The storage drive mechanism locks during paying out cable from the drum so that the entire rotational movement of the drum during paying out of cable occurs by slipping of the friction coupling. The storage drum drive mechanism includes a shaft having mounted thereon a chain wheel including a free wheel device which locks to drive the chain wheel when the shaft rotates in a direction consistent with the reeling in of cable. On the other hand, the device free wheels allowing the wheel to remain stationary when the shaft rotates in a reverse direction consistent with paying out of the cable.

The chain wheel which includes the free wheel device is drivingly connected to a second chain wheel rotatable with a shaft which in turn is rotatable with a friction plate arranged in frictional driving contact with the storage drum. The shaft to which the friction plate is secured is connected with another free wheel device which prevents the shaft from rotating in a direction consistent with paying out of the cable from the storage drum, whereby such rotation of the drum occurs by slipping of the friction coupling.

In winches to be used for hauling heavy loads, it is preferred not to include a bevel gear in the gearbox for driving the twin haulage capstans. In this case, the gearbox preferably comprises only spur gears having parallel shafts which lie adjacent a substantially horizontal plane in which the axis of the twin haulage drums lie. The spur gears may or may not be chain driven.

For further detail of the above-described arrangement, reference is made to the Alexander patent, U.S. Pat. No. 3,834,673, which is expressly incorporated herein by reference.

The haulage capstan 16 may be chain driven either from the input shaft from the gearbox for the winch or may be independently driven from a motor, such as a hydraulic motor, other than that used to drive the input shaft to the double capstans. This is schematically shown in FIG. 4 as the drive mechanism 36.

A tripping device (not shown) is disposed between the haulage capstan and the capstan 14 which receives the line 18 from the haulage capstan 16. When activated, the tripping device cuts off the drive to the storage drum and to the capstans 12, 14 but not to the haulage capstan 16. In this manner, the chain 20 may be taken up by operation of the haulage capstan 16 and deposited within the locker 6.

In more detail, in operation of the winch for raising, for example, an anchor attached to an anchor chain which is connected to a cable, the cable is hauled in first and passes under and around the haulage capstan 16 to the top of the capstan 16. From there, the cable passes downwardly under the capstan 14 and extends around the capstans 12, 14 several times in the grooves thereof. The cable then passes upwardly from the capstan 12, 14 to the automatic spoolage device 34 which feeds the cable to the storage drum.

Eventually the chain reaches the haulage capstan 16. When the chain first passes over the capstan 16 it strikes an obstruction on the tripping device which causes the drive to the storage drum and the capstans 12, 14 to be stopped. However, the haulage capstan 16 continues to rotate and the chain passes over the haulage capstan 16 and falls into the storage locker 32. Owing to the slight inclination of the axes of the haulage capstan 16 to the horizontal, the part of the chain which falls into the locker 32 does not interfere with the part of the chain which is being delivered to the capstan 16.

There are other suitable embodiments for depositing the chain 20 into the locker 32. One such embodiment merely releases the drive to the storage drum. This releases the back tension to the capstans 12, 14 which in turn allows the line 18 to disengage from contact with the grooves of the capstans, due to the natural elastisity of the wire line. This disengagement is an effective clutching which discontinues hauling in of the cable 22 during hauling in of the chain 20. This method is advantageous in that it simplifies the drive mechanism to the winch 10 by obviating the necessity for the above described trip mechanism.

A winch in accordance with this aspect of the invention has the advantage that the bearing loads on the capstans 12, 14 are substantially reduced due to the effect of the haulage capstan 16. Reduction of the bearing loads enables the size of the components in the twin capstan section and the power supply requirements therefore to be reduced for a winch having a given maximum load, as compared with a winch comprising twin capstans but no haulage capstan associated therewith.

Further, the use of a leading haulage capstan of large diameter has the advantage that the pressure between the cable and the haulage capstan, during hauling, can be maintained at a low level. This enables the winch 10 to be used for hauling relatively inexpensive cables. There is also the possibility of using very high strength plastics material cables which, when subjected to high compressive stresses on drum winches of the standard type tend to be destoyed by being stored on the drum at very high pressures.

Referring now to FIGS. 3 and 4, another embodiment of the multi-capstan winch 10 is depicted. In this embodiment, the haulage capstan 16 is coaxial with the capstan 14. As seen in FIG. 3, during take up the haulage capstan 16 is driven (by equipment not shown but which may be as described for the embodiment of FIG. 1) in a rotational direction opposite to that of the capstans 12, 14. (Likewise, the tripping device, the storage drum, the spooling device and the locker features described with respect to FIG. 1 may be employed with respect to the winch 10 shown in FIG. 3.)

As an outstanding feature of the invention, and as is also shown in FIG. 1, the line 18 is wrapped around the capstans 12, 14, 16 in a manner to effect optimum utilization of the hauling capstan 16 for reducing the load on the capstans 12, 14. By reducing the loading on the capstans 12, 14, the capstans 12, 14 and associated drive and support equipment such as bearings, etc. are advantageously reduced to provide an overall cheaper and lighter weight system.

More specifically, the line 18 is fed to the capstan 16 where it engages the capstan 16 at a point A on one side of the coaxial plane. The line 18 thereupon wraps around the capstan 16 less than a single full wrap, but more than an one-half wrap to a point B on the other side of the coaxial plane. The angle from the point A to the point B around the capstan 16 is between 190 degrees and 300 degrees, and preferably 220 degrees.

From the point B on the capstan 16, the line 18 is unimpededly passed directly to the capstan 12 where it engages the capstan 12 at a point D on the one side of the coaxial plane. It is noted that a segment C of the line 18 crosses the coaxial plane at a location between the capstans 12, 14; i.e. there is a crossover of the line 18.

From the point D, the line 18 wraps around the capstan 12 to a point E on the other side of the coaxial plane where it is fed to the capstan 14. The value of the angle between the points D and E around the capstan 12 also varies between 190 degrees–300 degrees and is preferably 220 degrees.

After the line 18 is fed to the capstan 14, it is wound around the capstans 14, 12 a plurality of times, the wrap on each of the capstans 12, 14 being approximately 180 degrees due to there being no further crossovers of the line 18.

The size of the capstans 12, 14, 16 and the separation between the capstans 12, 14, and 16 determine the particular value of the wraparound between the points A–B and the points D–E. Capstans of a smaller diameter and which are closer together achieve a greater wraparound angle than the converse situations. Of course, the greater the angle of wraparound on the capstan 16, the greater the load reduction on the capstans 12, 14.

As an example, assuming wraparounds of 220 degrees between the points A–B and D–E, and assuming an initial loading on the line 18 of 100 tons applied at the point A, the haulage capstan 16 reduces the load to approximately 65 tons on the crossover segment C. Accordingly, the relatively smaller-in-diameter capstans 12, 14 need accommodate a considerably reduced load. After the 220 degree wrapparound on the capstan 12, the load is further reduced to approximately 43 tons. It thus will be appreciated that the crossover segment C, effecting the increased wraparound on the capstan 16, is an outstanding feature which allows the capstans 12, 14 to have the respective diameters reduced.

It is further noted that a capstan 12, 14 diameter to rope diameter ratio of 12 is preferred. Use of such a ratio assures that the line 18 will not suffer undue stresses when bending around the relatively smaller diameter capstans 12, 14.

Although rather detailed embodiments have beed described, it is understood that various modifications to these structures and arrangements will be apparent without departing from the spirit and scope of the invention as hereinafter claimed.

What is claimed is:

1. A multi-capstan winch for hauling in a cable under load, comprising:

a. At least first, second, and third rotatably disposed capstans, the second and third capstans being of reduced diameters, and the first capstan being of an enlarged diameter, the second and third capstans configured to receive a plurality of wraps of the cable, and the first capstan configured to receive between 190 degrees and 230 degrees of wrap of the cable; and b. Means for rotatably driving the first, second, and third capstans during hauling in of the loaded cable such that the first capstan delivers the loaded cable to one of the second or third capstans.

2. The multi-capstan winch according to claim 1 wherein during hauling the cable unimpededly runs directly from the first capstan to the second capstan.

3. The multi-capstan winch according to claim 2 wherein the angle of the wrap around the first capstan is approximately 220 degrees.

4. The multi-capstan winch according to claim 3 wherein said firstr capstan is a single groove capstan.

5. The multi-capstan winch according to claim 2 wherein said second and third capstans have coplanar axes and the axis of said first capstan is tilted with respect to the axes of the other capstans.

6. The multi-capstan winch according to claim 5 wherein the axis of the first capstan is fixed at said tilt with respect to the axes of the other capstans.

7. In a multi-capstan winch having at least three capstans adapted to be driven about co-planar axes for hauling in a cable under load, a first relatively larger one of the capstans being coaxial with one of two relatively smaller of the capstans and disposed for delivering the loaded cable to the other of said smaller capstans, the improvement wherein the two capstans are configured to receive a plurality of turns of the cable under load and wherein the first capstan is configured to receive greater than one-half a turn but less than a full turn of the cable under load.

8. The multi-capstan winch according to claim 7 wherein during hauling said cable unimpededly passes directly between said first capstan and the other of said two capstans.

9. The multi-capstan winch according to claim 8 wherein during hauling the angle of wrap around said first capstan is within the range of 190 degrees –230 degrees.

10. The multi-capstan winch according to claim 8 wherein during hauling the wrap around the first capstan is approximately 220 degrees.

11. The multi-capstan winch according to claim 8 wherein during hauling, the cable initially approaches said first capstan on one side of said axial plane, leaves the first capstan on the other side of said plane, and approaches said other capstan on said one side of said plane.

12. The multi-capstan winch according to claim 7 wherein said first capstan is a single groove capstan.

13. The multi-capstan winch according to claim 7 wherein said first capstan is configured to accommodate a hauling line comprising both a length of said cable and a length of chain 14. A method of hauling cable under load using a double capstan which comprising the steps of:

passing the cable under load around a third driven capstan, the angle of wrap around the third capstan lying within the range of 190 degrees–230 degrees; and delivering the cable under load from the third capstan to the double capstan winch whereby during hauling the double capstan winch receives the cable with reduced loading from the third capstan winch.

15. The method according to claim 14 wherein the angle of wrap around the third capstan is substantially 220 degrees.

16. The method according to claim 14 wherein the step of delivering includes the step of unimpededly passing the line directly between the third capstan and the double capstan winch.

17. A multi-capstan winch for hauling in a cable under load, comprising:

a. At least first, second, and third rotatably disposed capstans, the second and third capstans configured to receive a plurality of wraps of the cable and the first capstan configured to receive less than a single full wrap but more than a one-half wrap of the cable; and b. Means for rotatably driving the first, second, and third capstans during hauling in of the loaded cable such that the first capstan delivers the loaded cable to one of the second or third capstans, wherein all said capstans have coplanar axes and whereby during hauling the cable approaches the first capstan on one side of said axial plane, leaves the first capstan on the other side of said capstan plane, and approaches said second capstan on said one side of said plane.

18. The multi-capstan winch according to claim 17 wherein said first capstan is coaxial with one of said second and thired capstans.

19. The winch according to claim 17 wherein the second and third capstans are of a reduced diameter.

* * * * *